US005427320A

United States Patent [19]

Mak et al.

[11] Patent Number: 5,427,320

[45] Date of Patent: Jun. 27, 1995

[54] WATER GUN WITH SWEEPING SHOOTING ACTION

[76] Inventors: David Mak; Ho S. Mak, both of 1363 Virginia Rd., San Marino, Calif. 91108

[21] Appl. No.: 305,570

[22] Filed: Sep. 14, 1994

[51] Int. Cl.[6] ..... B05B 3/02

[52] U.S. Cl. ..... 239/587.5; 222/79; 239/225.1

[58] Field of Search ..... 239/587.1, 264, 225.1, 239/587.5; 222/79; 273/349; 446/473, 483

[56] References Cited

U.S. PATENT DOCUMENTS

| | | | |
|---|---|---|---|
| Re. 24,208 | 9/1956 | Steiner . | |
| 2,888,172 | 5/1959 | O'Brian . | |
| 3,146,911 | 9/1964 | Shun . | |
| 3,940,072 | 2/1976 | Ishikawa et al. | 239/587.5 |
| 4,492,318 | 1/1985 | Luk | 222/79 |
| 4,842,200 | 6/1989 | Hermansson | 239/264 |
| 5,150,819 | 9/1992 | Johnson et al. | 222/79 |
| 5,244,153 | 9/1993 | Kuhn et al. | 239/587.5 |

FOREIGN PATENT DOCUMENTS

| | | | |
|---|---|---|---|
| 2304738 | 8/1974 | Germany | 239/587.5 |
| 1011057 | 11/1965 | United Kingdom | 222/79 |

*Primary Examiner*—Andres Kashnikow
*Assistant Examiner*—Christopher G. Trainor
*Attorney, Agent, or Firm*—Ladas & Parry

[57] ABSTRACT

The present invention is a nozzle gun assembly that is axially mounted toward the front of the water gun barrel of a conventional pump-action-type water gun. The nozzle assembly has a nozzle head with a control wheel section. The squirting of the water gun simultaneously causes the actuating member to act against the control wheel, thereby turning the nozzle head on its axis. In this manner, as water is pumped through the nozzle head and out the nozzle, the nozzle head is accordingly rotated so that the stream emitted from the water gun travels an angular path, eg. from left to right. The assembly also has means for disconnecting the actuating member from the control wheel so that the water gun can be utilized in a more conventional manner.

7 Claims, 3 Drawing Sheets

WATER GUN WITH SWEEPING SHOOTING ACTION

FIELD OF THE INVENTION

This invention pertains to the field of water Guns, and more particularly to a water gun that shoots a stream of water in a sweeping angular motion without action on the part of the shooter to turn the direction of nozzle.

BACKGROUND OF THE INVENTION

Water guns have been known for many years. Every child has, on one occasion or another, had the opportunity and the joy of pulling the trigger of a water gun and drenching a friend with a splash of $H_2O$. The friend, more often than not, survived the attack only to seek vengeance with a hail of squirts from a water gun of his or her own.

The basic water gun usually takes the form of a pistol or rifle with a mechanism to directly pump water at a target or by pressurization prior to shooting. The gun barrel is aimed at a target and the stream of water released.

Some toy water guns have been developed with nozzles that can be rotated to shoot a stream of water at varying angular directions. For example, U.S. Pat. No. 5,244,153 describes a water gun with a directional nozzle that is connected to a handle by a belt, gear, chain or other rotatable drive mechanism. The user's rotating of the handle causes the nozzle to rotate to the same extent.

U.S. Pat. No. Re. 24,208 shows a toy water pistol which has a control knob attached to the nozzle. The direction of the nozzle, and thereby the direction of the water, may be changed relative to the direction in which the pistol is pointed by manually turning the control knob.

U.S. Pat. No. 2,888,172 shows a toy water gun where the direction of the water stream can be adjusted up and down by manipulating the handle which is linked to the nozzle.

U.S. Pat. No. 3,146,911 describes a water gun that has a multi-directional nozzle. The nozzle is adjusted by manipulating a knob which acts on a belt to change the orientation of the nozzle.

U.S. Pat. No. 4,492,318 shows a toy water pistol with a simple mechanism for adjusting the direction of the water stream by turning a cylindrical knob that is attached to the nozzle.

None of the prior art teaches the emitting of a stream of water in a sweeping side-to-side motion by the mere actuation of the squirting mechanism.

SUMMARY OF THE INVENTION

The present invention provides a nozzle gun assembly that is axially mounted toward the front of the water gun barrel of a conventional pump-action-type water gun. The nozzle assembly has a nozzle head that is rotatably attached to the shell of the water gun. The nozzle head has a control wheel appendage that has a seat for and can be acted upon by an actuating member. The pumping of the water gun simultaneously causes the actuating member to act against the control wheel, thereby turning the nozzle head on its axis. In this manner, as water is pumped through the nozzle head and out the nozzle, the nozzle head is accordingly rotated so that the stream emitted from the water gun travels an angular path, eg. from left to right. The assembly also has means for disconnecting the actuating member from the control wheel so that the water gun can be utilized in a more conventional manner.

BRIEF DESCRIPTION OF THE DRAWINGS

In describing the invention, reference will be made to the accompanying drawings wherein.

DETAILED DESCRIPTION

The present invention is a nozzle assembly that allows the user to fire a stream of water from a water gun while simultaneously rotating the nozzle head. The combination of these two contemporaneous actions, the shooting of the stream of water and the rotating of the nozzle head, causes the resultant stream emitted from the water gun to sweep through an angular motion and be able to strike more than one target.

In the preferred embodiment described herein, the nozzle assembly is utilized with a pump-action water gun that is known in the art. In this pump-action water gun, a rear portion of the water gun is slidably mounted with respect to a front portion. The rear portion contains a water storage reservoir and a piston rod which extends from the rear portion and into a cylinder located in the front portion. When the front portion of the water gun is pulled away from the rear portion of the gun, the piston rod is withdrawn from the cylinder, creating a suction that causes water to be sucked into the cylinder from the water reservoir. The two portions are then pushed together with respect to each other, and the piston rod acts on the water in the cylinder to create the hydraulic pressure that propels the water from the gun. However, the nozzle assembly which is the object of this patent may be adapted to other types of water guns so long as the action applied by the user to cause water to be emitted from the water gun also concurrently causes the nozzle to rotate.

Figure 1:
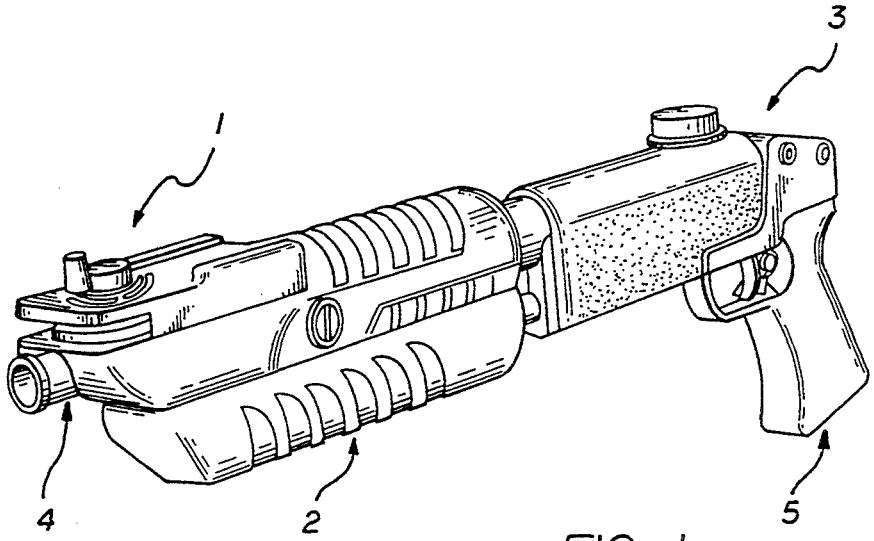
FIG. 1 is a perspective view of the water gun of the invention.

Referring now to the drawings, there is illustrated in FIG. 1 a view of a conventional pump-action water gun with the nozzle assembly 1 of this invention. The pump-action water gun has a front portion 2 and a rear portion 3. The two portions are slidably mounted with respect to each other. The front portion includes barrel 4 and the rear portion includes handle 5.

Figure 2:
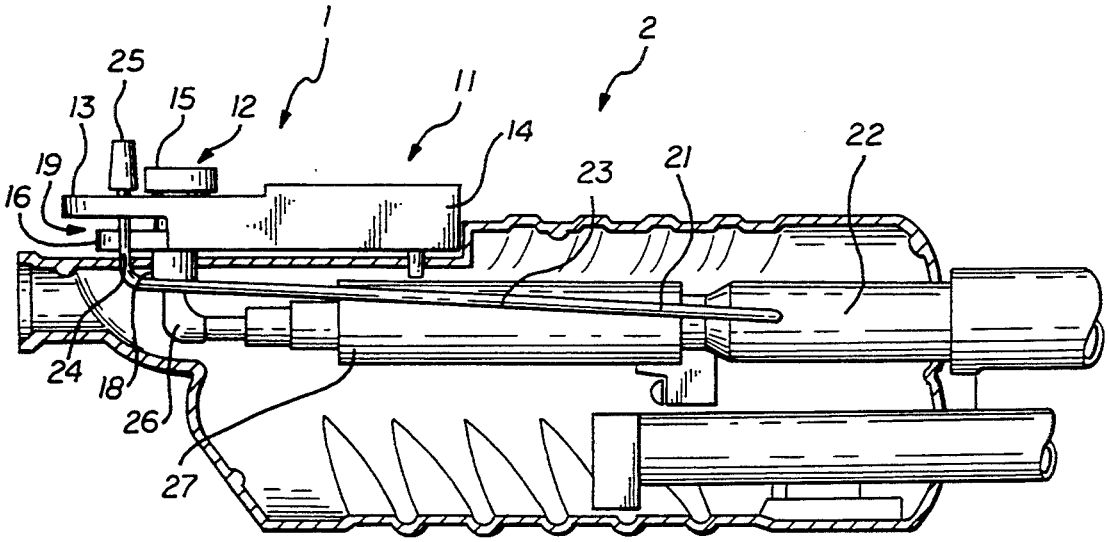
FIG. 2 depicts a side cut view of the barrel and the present invention nozzle assembly.

FIG. 2 is a side sectional view of the front portion 2 and provides a clear illustration of the nozzle assembly 1. The assembly has a support 11 on which a nozzle head 12 is axially and rotatably mounted. Support 11 may be integrally formed on the water gun or may be a separate component that is attached to the water gun barrel 4, as is illustrated in FIG. 2. Support 11 preferably has a top plate 13 and a base 14. Nozzle head 12 has a rotating knob portion 15, the purpose of which will be described later. Nozzle head 12 also preferably has integrally formed thereon a control wheel 16, a nozzle 17 (more clearly seen in FIG. 5), and a collar portion 18. A spatial opening 19 is provided between top plate 13 and control wheel 16 for a water stream to exit nozzle 17. An actuating member 21 is attached to a piston rod 22 of the water gun and preferably includes a main extension section 23, an elbow section 24, and a control knob 25. A tube 26 connects cylinder 27 to nozzle head 12 and provides a passage for water from cylinder 27 to nozzle 17.

Figure 3:
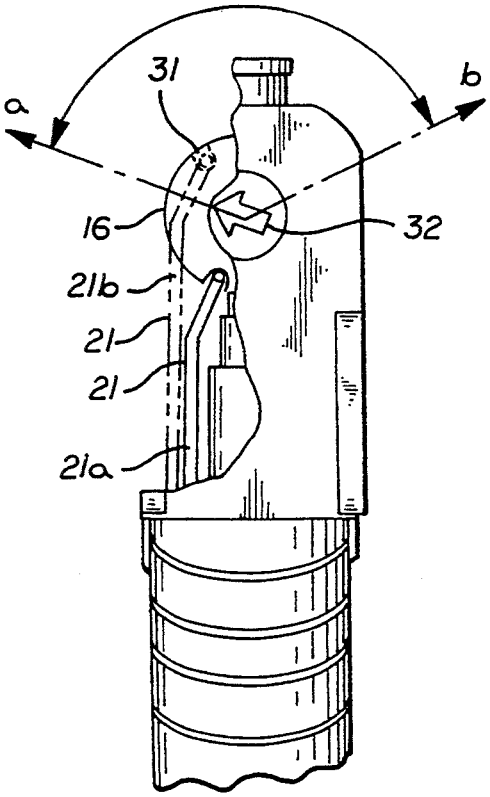
FIG. 3 is a plan view of the water gun barrel with part of the barrel removed to more easily depict the nozzle assembly of the invention.
Figure 5:
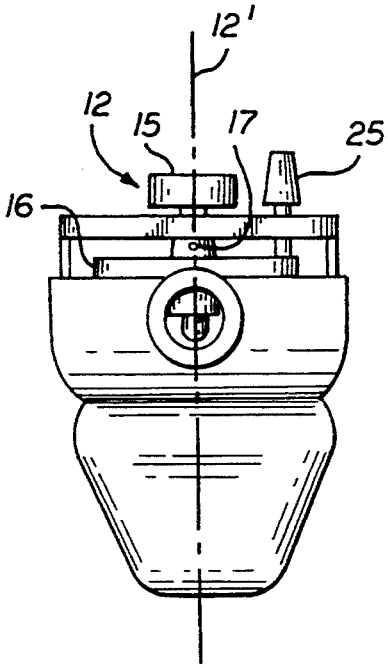
FIG. 5 is a frontal view of the gun barrel.

FIG. 3 provides a plan view of the assembly and water gun barrel 4 with part of the support 11 cut-away. This view clearly illustrates the control wheel 16 with notch 31 which accepts the elbow section 24 of actuating member 21. The actuating member 21 is shown in two positions. The first position 21*a*, in solid lines, shows the actuating member 21 when the rear portion 3 is drawn back away from the front portion 2. When the front portion 2 and rear portion 3 are pushed together, pumping a stream of water from the water gun, the forward motion of the piston rod 22 causes actuating member 21 to be urged against notch 31 of the control wheel 16, which in turn causes the control wheel 16 and nozzle head 12 to rotate on its axis 12' (FIG. 5). The actuating member depicted in dotted lines 21*b* reflects the position of the control wheel 16 and actuating member 21 after the control wheel 16 has been rotated. The direction in which nozzle 17 is currently pointing is indicated to the user by arrow 32, and in FIG. 3 the current position corresponds to direction "*a*" and to the first position 21*a* of the actuating member 21. During use of the water gun as described above, the nozzle 17 is angularly displaced from position "*a*" to position "*b*" in response to movement of the actuating member 21 from its starting position 21*a* to its end position 21*b*.

In this particular embodiment of the nozzle assembly 1, it will be appreciated that the angular difference between positions "*a*" and "*b*" will be somewhat less than 180 degrees. This is because for control wheel 16 to rotate in the desired position, i.e. for actuating member 21 to move from position 21*a* to 21*b*, the limitation on the range of rotation for notch 31 is preferably less than 180 degrees. To illustrate, when viewing the control wheel 16 from a planar position as in FIG. 3, the beginning position of notch 31 is preferably at greater than six o'clock or control wheel 16 will not rotate in the desired, in this particular case,-clockwise direction. Similarly, after the expelling of water has been completed, notch 31 should be at less than 12 o'clock or, when the pump-action is reversed and piston rod 22 is withdrawn from cylinder 27, actuating member 21 will not rotate in a counter-clockwise direction and return to a substantially 21*a* position.

Figure 4:
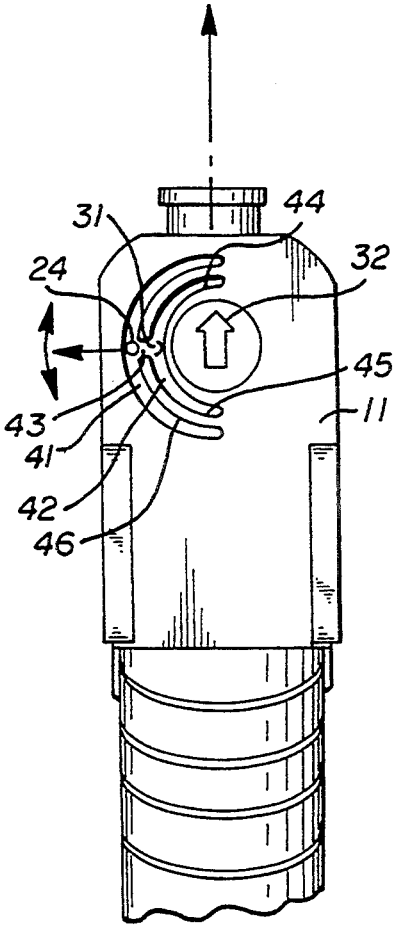
FIG. 4 is a plan view of the water gun barrel without the control knob.

Referring now to FIG. 4, support 11 has outer track-like opening 41 and inner track-like opening 42, both arcuately formed thereon. Inner track-like opening 42 has a smaller diameter than outer track-like opening 41 and both are spatially connected by a nexus 43. Said track-like openings are concentric, roughly 180 degree semi-circular arcs. As depicted in FIG. 4, the radius of inner track-like opening 42 is such that notch 31 is disposed directly below, i.e. the radius of the inner side wall 44 of inner track-like opening 42 is substantially the same as the radius at the inner side of the notch 31. The radius of control wheel 16 is preferably greater than the radius of the outer side wall 45 of inner track-like opening 42 but less than the radius of the inner side wall 46 of outer-track-like opening 41. Both outer track-like opening 41 and inner track-like opening 42 also share substantially the same axis 12' as control wheel 16. Therefore as control wheel 16 is rotated about its axis 12', notch 31 basically follows the arc defined by inner track-like opening 42 when viewed from above as in FIG. 4.

FIG. 5 provides a frontal view of the gun barrel 4. Nozzle head 12, rotating knob 15, and control wheel 16 are seen as sharing the same axis 12'. Nozzle 17 is clearly viewed on nozzle head 12.

Figure 6:
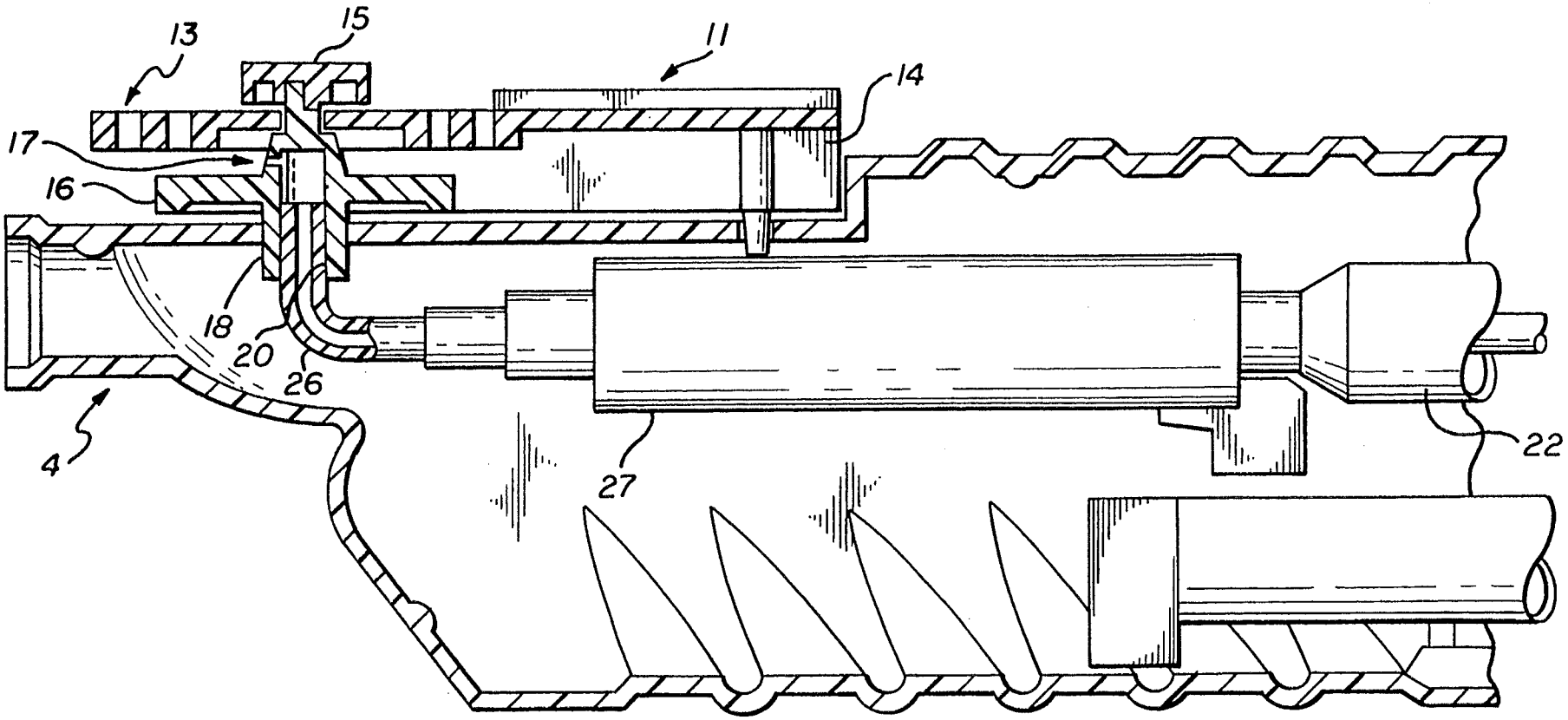
FIG. 6 is a partial sectional view in which the nozzle assembly is viewed through axis 12'.

FIG. 6 is a side sectional view partially through axis 12'. This view illustrates the nozzle assembly 1 along the central axis of nozzle head 12. In the preferred embodiment, the nozzle head 12 is rotatably held in place between top plate 13 and barrel 4. Tube 26 connects the cylinder 27 to nozzle head 12 and provides access for water pumped from cylinder 27 to nozzle 17 which is located on nozzle head 12 and has clearance between the barrel 4 and top plate 13. Tube 26 is tightly fitted into cylinder 27 at one end and also tightly fitted into the lower portion of nozzle head 12 at its other end. When actuating member 21 acts on control wheel 16, control wheel 16 rotates in relation to tube 26. However, tube 26 must be tightly fitted into nozzle head 12 so that water will not leak out of the tube-control head attachment when water is squirted out. To encourage such a tight fit, the inner diameter of collar portion 18 defined by inner wall 20 very gradually tapers and narrows toward control wheel 16 to a diameter slightly less than the diameter of tube 26.

The piston rod 22 and the cylinder 27 are not illustrated in sectional view and the pump-action system will not be further discussed herein because it is conventional and well-known in the art.

The two track-like openings serve as guide channels for the elbow section 24 of the actuating member 21. As illustrated in FIG. 2 and FIG. 4, elbow section 24 is disposed through the opening formed by outer track-like opening 41, inner track-like opening 42 and nexus 43, which joins the two track-like openings. When control knob 25 is grasped and elbow section 24 is inserted into outer track-like opening 41, the pump action to shoot a stream of water causes the actuating member 21 to move and elbow section 24 to travel within outer track-like opening 41. But because of the greater radius of outer track-like opening 41 in relation to the radius of control wheel 16, the elbow section 24 does not act to rotate the nozzle head 12. Thus, the stream of water will be expelled linearly as in a conventional water gun. Manual manipulation of the rotating knob 15 will direct the nozzle 17 in the direction desired by the user. Using arrow 32 as a directional guide, nozzle 17 can be aimed not only toward a forward position, but also selectively in sideward position to strike unsuspecting targets standing next to the user.

When the elbow section 24 is placed within notch 31 and consequently into inner track-like opening 42, the pumping of the water gun will cause actuating member 21 to act on control wheel 16 and rotate the nozzle head 12. As the nozzle head 12 turns simultaneously with the shooting of the stream of water, the stream sweeps angularly across and is capable of striking more than one target.

It will be appreciated that while the nozzle assembly has been described above as used in connection with a "pump-action" squirting mechanism, structural modifications can be made to adapt the assembly to alternative and known squirting mechanisms so that the singular action of activating the water stream will also simultaneously cause a nozzle to rotate, resulting in a sweeping action on the part of the water stream across an angular field.

It is to be understood that for purposes of clearly illustrating the invention, the drawings do not necessarily depict the various components in their relative proportions. The drawings and the foregoing description are also not intended to represent the only form of the invention in regard to the details of its construction and manner of operation. Obviously, numerous modifications and variations of the present invention are possible in light of the above teachings. Changes in form and in the proportion of parts, as well as the substitution of equivalents, are contemplated as circumstances may suggest or render expedient; and although specific terms have been employed, they are intended in a generic and descriptive sense only and not for the purpose of limitation, the scope of the invention being delineated in the following claims:

The invention is claimed as follows:

1. A nozzle assembly for use with a water gun with a squirting mechanism, said assembly comprising:

a nozzle head having a nozzle, said nozzle head rotatably disposed on said water gun;

means for actuating said nozzle head so that when said squirting mechanism is triggered to shoot a stream of water from said nozzle, said actuating means causes said nozzle to simultaneously rotate and thereby said stream of water to sweep through an angular motion.

2. A nozzle assembly for use with a water gun with a squirting mechanism, said assembly comprising:

a nozzle head having a nozzle, said nozzle head rotatably disposed on said water gun;

an actuating member connecting said nozzle head to said squirting mechanism so that when said squirting mechanism is triggered to shoot a stream of water from said nozzle, said actuating member causes said nozzle to simultaneously rotate and thereby said stream of water to sweep through an angular motion.

3. A nozzle assembly as claimed in claim 2 wherein said nozzle head has a control wheel axially aligned with said nozzle head, said control wheel having a notch into which a portion of said actuating member is disposed and from which said portion of said actuating member can be removed so that movement of said actuating member cannot cause said nozzle head to rotate.

4. A nozzle assembly as claimed in claim 2 wherein said water gun has formed thereon an inner track and an outer track, both tracks are arcuate openings and both are connected by a nexus, said inner track having a lesser diameter than said outer track, said inner track and said outer track having an axis corresponding to an axis of said nozzle head and said control wheel, said control wheel having a notch into which a portion of said actuating member is disposed and from which said portion of said actuating member can be removed so that movement of said actuating member cannot cause said nozzle head to rotate.

5. A toy water gun, which comprises:

a main housing comprising a front portion and a rear portion, said front portion having a gun barrel;

water squirting means comprising a cylinder attached to the front portion and a piston rod attached to the rear portion, said piston rod slidably mating within said cylinder;

a support disposed on said barrel;

a nozzle head rotatably disposed on said support, said nozzle head having a nozzle, and a rotating knob and control wheel that share the substantially the same axis as the nozzle head;

an actuating member having a first end and a second end, said first end connected to said piston rod and said second end coupled to said control wheel of said nozzle head, such that when water is placed in said cylinder, and said rear portion is pushed against said front portion causing said piston to be inserted further into said cylinder, said actuating member will act on said control wheel and cause said nozzle head to rotate about its axis, whereby the water issuing from said nozzle simultaneously with said rotation of said nozzle head will cause said water to sweep in an angular manner.

6. A toy water gun as claimed in claim 5 wherein said second end of said actuating member is curved at about ninety degrees in relation to the substantial remainder of the actuating member, and said control wheel has a seating on its periphery onto which said second end of said actuating member can be removably disposed wherein when said second end is disposed in said seating, movement of said actuating member will rotate said nozzle head and wherein when said second end is disengaged from said seating, movement of said actuating member will not rotate said nozzle head.

7. A toy water gun as claimed in claim 6 further comprising an inner track and an outer track formed on said support, both said tracks arcuately shaped with said outer track having a larger radius than said inner track, both said tracks sharing substantially the same axis as said nozzle head and both said tracks spatially connected by a nexus, said inner track having a radius slightly larger than the radius of said control wheel, said second end of said actuating member protrudes through one of said tracks, wherein when said second end protrudes through said inner track and said second end is disposed within said seating, movement of said actuating member will rotate said nozzle head, and wherein when second end is placed in said outer track, said second end cannot be engaged with said seating and movement of said actuating member will not rotate said nozzle head.

* * * * *